United States Patent [19]

Dibrell

[11] 4,433,551

[45] Feb. 28, 1984

[54] METHOD AND APPARATUS FOR DERIVING MECHANICAL ENERGY FROM A HEAT SOURCE

[75] Inventor: Edwin W. Dibrell, San Antonio, Tex.

[73] Assignee: Centrifugal Piston Expander, Inc., San Antonio, Tex.

[21] Appl. No.: 460,605

[22] Filed: Jan. 24, 1983

Related U.S. Application Data

[63] Continuation-in-part of Ser. No. 436,412, Oct. 25, 1982, Ser. No. 436,852, Oct. 25, 1982, and Ser. No. 451,606, Dec. 20, 1982.

[51] Int. Cl.[3] ..... F25B 9/00

[52] U.S. Cl. ..... 62/87; 62/403; 62/499; 165/86

[58] Field of Search ..... 62/499, 235.1, 403, 62/87; 165/86

[56] References Cited

U.S. PATENT DOCUMENTS 1,323,785 12/1919 Nichol .
1,511,985 10/1924 Spencer .
2,174,584 10/1939 Imus .
2,175,162 10/1939 Waterfill .
2,716,971 9/1955 Sykes .
2,730,874 1/1956 Schelp .
3,052,106 9/1962 Sampietro et al. .
3,648,670 3/1972 Siddons .
3,896,632 7/1975 Huntley .
4,022,032 5/1977 Nott ..... 62/499

*Primary Examiner*—Ronald C. Capossela
*Attorney, Agent, or Firm*—Fraser, Barker, Purdue & Clemens

[57] ABSTRACT

The invention provides a method and apparatus for operating any centrifugal piston expander to convert energy derived from a heat source into mechanical energy. Pressured gas received from the heat source is circulated through the centrifugal piston expander, then to a series connected heat exchanger and compressor to recompress same and to remove sufficient heat to satisfy the entropy requirements of the closed cycle, and then is resupplied to the heat source for recirculation. Several types of centrifugal piston expanders are disclosed including one type wherein the centrifugally produced stroke of each piston is utilized to force the expanded gas into the subsequent apparatus.

9 Claims, 9 Drawing Figures

METHOD AND APPARATUS FOR DERIVING MECHANICAL ENERGY FROM A HEAT SOURCE

RELATIONSHIP TO OTHER PENDING APPLICATIONS

This application constitutes a continuation-in-part of my co-pending applications Ser. No. 436,412, filed Oct. 25, 1982, Ser. No. 436,852, filed Oct. 25, 1982, and Ser. No. 451,606, filed Dec. 20, 1982.

BACKGROUND OF THE INVENTION

1. FIELD OF THE INVENTION

The invention relates to a method and apparatus for converting heat energy into mechanical energy through the utilization of a pressured gas circulating around a closed cycle including an expander of the type wherein cooperating cylinder and piston assemblies are mounted for rotation on a power output shaft in such manner that the pistons are movable in the cylinders solely by the action of the pressured gas thereon in one direction and by centrifugal force in the opposite direction and the reaction forces on the cylinders produces the mechanical energy output.

2. DESCRIPTION OF THE PRIOR ART

Literally hundreds of heat energy conversion systems have heretofore been proposed going back to the original invention of the steam engine. The devices most commonly employed to convert a pressured gas, such as steam, into mechanical energy comprise pistons reciprocable in fixed cylinders and rotary turbines.

In the co-pending application of James G. Adams, Ser. No. 343,240, filed Jan. 28, 1982, there is disclosed a rotary expander for use in an air conditioning system, comprising a plurality of cylinders mounted for rotation on a power shaft and defining paths of movement for cooperating pistons which extend from a point remote from the axis of rotation to a point proximate to the axis of rotation. With this arrangement, a charge of pressured gas introduced into a cylinder when the respective piston is in its remote position, will cause the piston to move inwardly toward its proximate position and effect an expansion and cooling of the gas charge. Contemporaneously, a reaction force is produced on the end wall of the cylinder which will assist in rotating the cylinder and the connected power shaft, and thus a more efficient system for effecting the expansion and cooling of the charge of gas was disclosed.

In my above mentioned co-pending parent applications Ser. Nos. 436,412, 436,852 and 451,606, the disclosures of which are incorporated herein by reference, there is disclosed and claimed a variety of configurations of rotating cylinders having cooperating pistons reciprocably movable therein solely through the action of a pressured gas and centrifugal force, between a position remote from the axis of rotation to a position proximate to the axis of rotation, hereinafter referred to as centrifugal piston expanders. In such co-pending applications, of which this application constitutes a continuation-in-part, it is disclosed that the various configurations of fluid pressure chambers defined by the rotating cylinders can efficiently be utilized as an engine to provide a source of motive power through the application of a pressured gas thereto. While specific examples of closed cycle air conditioning or air cooling systems were disclosed in the above-mentioned applications, a specific example of a closed cycle system for operating a centrifugal piston expander solely to produce a mechanical power output was not described. Such closed cycle system permits the utilization of phase changing gases, such as steam, and the common refrigerant gases, such as Freon, as the driving medium for any of the disclosed centrifugal piston expanders. Utilization of these gases to drive a centrifugal piston expander inherently requires a closed cycle system, and an operable closed cycle system for utilizing the unique centrifugal piston expanders disclosed in the aforementioned parent applications as engines has not heretofore been available.

SUMMARY OF THE INVENTION

The system for extracting mechanical energy from a heat source in accordance with this invention comprises a closed cycle circulation path for a gas which may comprise steam, or any of the commercially available refrigerant gases such as Freon, which is pressurized in a heat source chamber. The pressurized gas is applied to a centrifugal piston expander, which may comprise any one of the forms of such expander described in the aforementioned parent applications. The cooled expanded gas from the centrifugal piston expander is then applied to a heat exchanger, such as a condenser, for removal of additional heat from the gas and to satisfy the entropy requirements of the closed cycle. The thoroughly cooled gas, which might be partially liquified, is then introduced into a rotary compressor where it undergoes compression to a pressure level equal to or greater than the pressure level existing in a heat source chamber and it is resupplied to the heat source chamber in the form of either a liquid or gas-liquid mixture for reheating and repressurization. The heat source may comprise any conventional boiler, or a heat transfer device energized by solar energy. In accordance with one modification of the invention, the centrifugal piston expander, the rotary compressor and a starting motor are all mounted on a common power output shaft. The starting motor may be energized by a battery and then utilized as a generator driven by the centrifugal piston expander to charge the battery. In accordance with another modification of the invention, a rotary type heat exchanger is employed and the rotational elements of such heat exchanger are also driven by the common output shaft. In accordance with a still further modification of the invention, the valving arrangements for the centrifugal piston expander are such that the cooled exhaust gases generated in each of the cylinders are positively displaced from the cylinders by the centrifugally induced outward movement of the pistons. In any event, heat energy supplied by the heat source is efficiently converted into mechanical energy which is delivered by the output shaft to any desired form of energy consuming apparatus, and the energizing gas circulates in a closed cycle.

Further objects and advantages of the invention will be readily apparent to those skilled in the art from the following detailed description, taken in conjunction with the annexed sheets of drawings, on which is shown several preferred embodiments of the invention.

DESCRIPTION OF PREFERRED EMBODIMENTS

Figure 2:
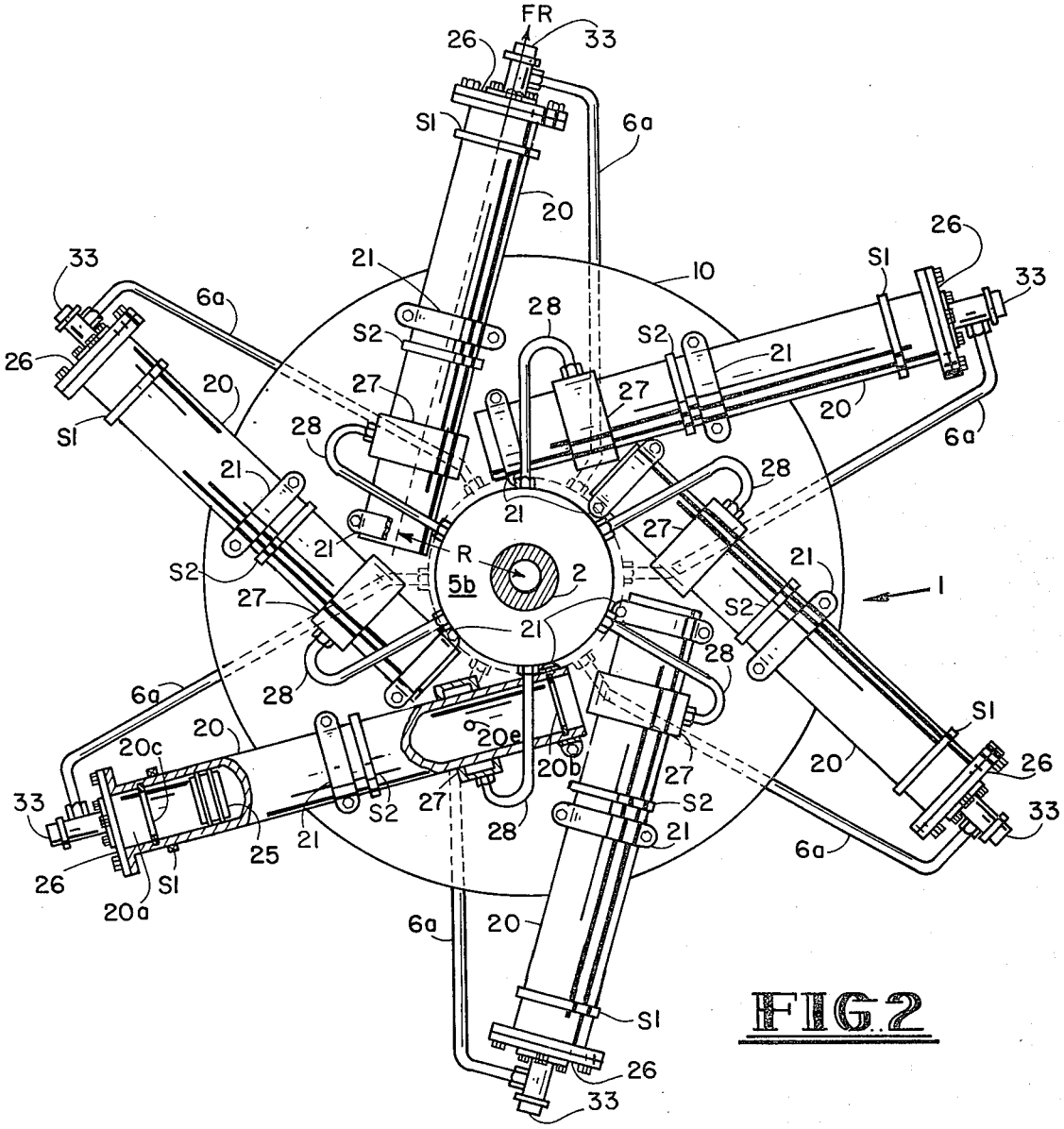
FIG. 2 is a sectional view taken on the plane 2—2 of FIG. 1.
Figure 1:
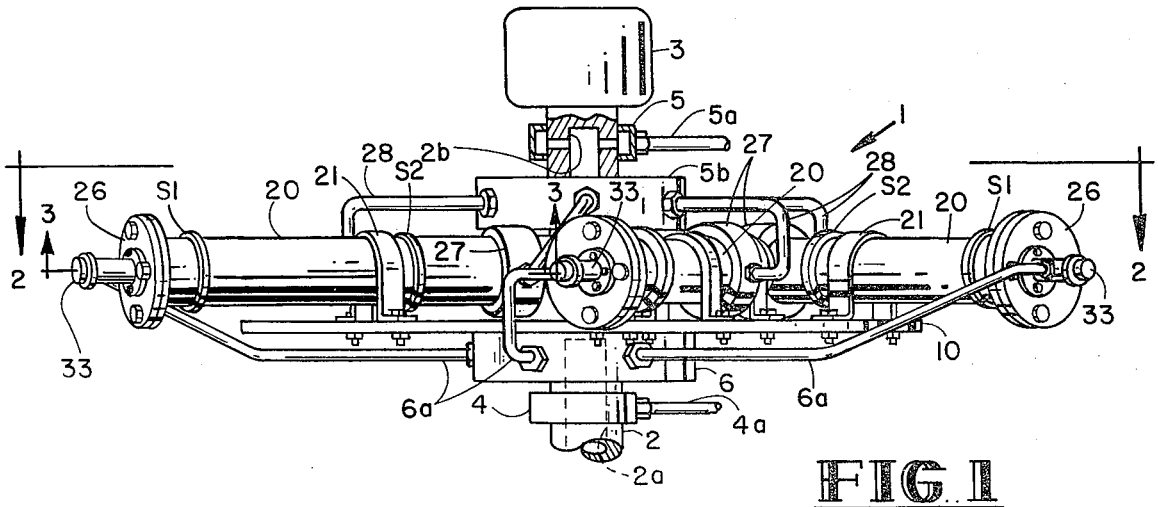
FIG. 1 is a schematic, side elevational view of a centrifugal piston expander of the type disclosed in my aforementioned co-pending parent applications.
Figure 3:
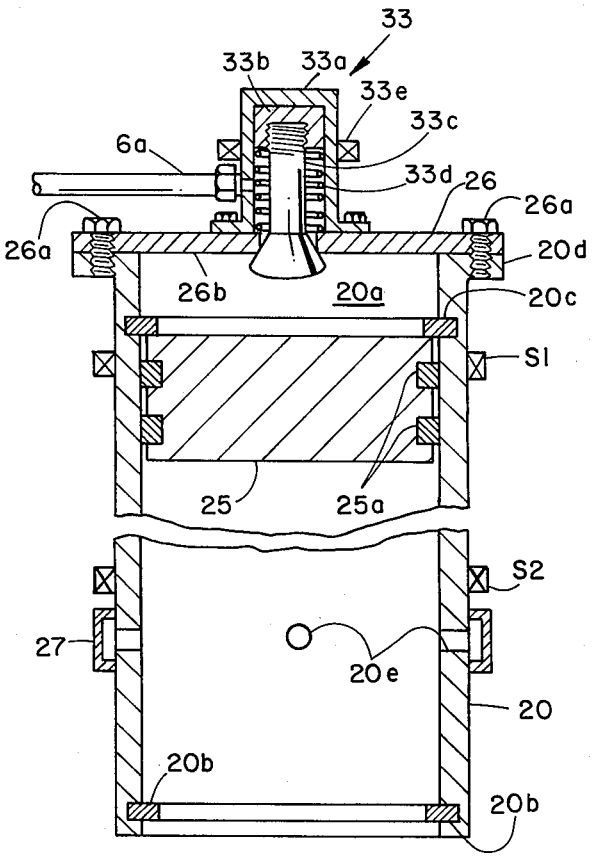
FIG. 3 is an enlarged, partial sectional view taken on the plane 3—3 of FIG. 1.

Referring first to FIGS. 1 through 4, there is schematically illustrated one of the centrifugal piston expander configurations disclosed in my aforementioned copending parent applications. Such expander comprises an apparatus 1 for extracting heat and mechanical energy from a pressured gas. Such apparatus is mounted on a circular plate or body 10 which in turn is keyed to a shaft 2 which is rotated by suitable electric or fluid pressure starting motor 3.

A conventional fluid shaft coupling 4 effects the supply of pressured gas to the apparatus from a stationary supply pipe 4*a* through a hollow bore portion 2*a* of the shaft 2 and into a distributor 6. The expanded and cooled exhaust gases are removed from the apparatus 1 through a conventional fluid shaft coupling 5 and supplied to a stationary exhaust pipe 5*a*. The exhaust coupling 5 communicates with another hollow portion 2*b* of the shaft 2 which, however, is isolated by suitable barrier (not shown) from the hollow bore portion 2*a* receiving the pressured inlet gases. Shaft bore portion 2*b* communicates with an exhaust gas collector 5*b*.

A plurality of cylinder elements 20 are rigidly mounted on the rotating body plate 10. Each such cylinder element defines a fluid pressure chamber 20*a* having a longitudinal axis which extends from a point proximate to the axis of rotation of the body 10 to a point radially remote from the axis of rotation. Each longitudinal axis of the cylinders 20 is, however, not radially disposed with respect to the axis of rotation of shaft 2 but is spaced therefrom.

To optimize the performance of apparatus 1, as many of the cylinders 20 are applied to the rotating body plate 10 as can be physically accommodated thereon. The exact number employed depends on a number of design factors, such as the pressure of the gas that is available to drive the unit, the space available to accommodate the unit, the rotational speed desired, the power output desired, and the weight limitations for the unit. Obviously, the larger the diameter of the individual cylinders 20, the smaller will be the total number of such cylinders that can be physically mounted on body plate 10. Likewise, the length of the cylinders 20 substantially increases the centrifugal forces acting on such cylinders and thus requires an increase in weight and strength of the cylinder components 20 as well as the body mounting plate 10 and the power driven shaft 2. In the specific example illustrated in the drawing, six of such cylinder units 20 are shown, and they are respectively secured to body plate 10 by bolted bands 21.

A free piston 25 (FIG. 3) is mounted in each of the bores 20*a* defined by the cylinders 20 for slidable and sealable movements therealong. Since the bore or fluid pressure chamber 20*a* of cylinder 20 is of cylindrical configuration, conventional piston rings 25*a* may be employed on the piston 25 or, alternatively, the pistons could be provided with an external coating of an organic material having good lubricating and sealing properties, such as a polytetrafluoroethylene, sold under the DuPont trademark "Teflon" or a perfluoroelastomer, sold under the DuPont trademark "Kalrez". Pistons 25 are preferably formed from a ferromagnetic material. Radially inward movement of each piston 25 is limited by a snap ring 20*b* mounted in the respective cylinder 20 and outward movement by a snap ring 20*c*. At the outer end of each cylinder 20, an outwardly projecting flange 20*d* is provided to permit a cylinder head 26 to be secured thereto by suitable bolts 26*a*. Centrally mounted on each cylinder head 26 is a solenoid actuated inlet valve 33 which is connected by a conduit 6*a* to a pressured gas distributor 6 which is concentrically mounted on the opposite face of the mounting plate 10. As previously mentioned, pressured gas is supplied to the distributor 6 through the fluid coupling 4 and the hollow bore portion 2*a* of the rotating power shaft 2.

Inlet valve 33 comprises a cylindrical non-ferrous casing 33*a* within which a ferromagnetic core or piston 33*b* is slidably mounted. The valving element 33*c* is threadably secured to the ferromagnetic piston element 33*b* and is normally spring biased to a closed position by spring 33*d*. A conduit 6*a* connects the interior of the valve housing 33*a* to the pressured gas distributor 6. Lastly, an actuating solenoid 33*e* is provided in surrounding relationship to the medial portion of the valve housing 33*a*. Such solenoid, when energized, will cause the ferromagnetic piston element 33*b* to be pulled downwardly to effect the opening of the inlet valve element 33*c*.

From the description thus far, it will be apparent that the pistons 25 move to their outermost positions in the respective fluid pressure chambers 20*a* by the centrifugal force generated by the rotation of power shaft 2 by the starting motor 3. When the pistons 25 reach their outermost position, then through the operation of a control circuit to be hereinafter described, the solenoid actuated inlet valve 33 is actuated to open and permit a charge of pressured gas to be introduced into the fluid pressure chambers 20*a*. If the pressure of such gas charge is sufficiently high, each piston will be moved inwardly against the centrifugal force bias by the force generated by such gas. Obviously, as each piston 25 moves inwardly, the centrifugal force acting on the pistons decreases, so that once inward motion of the piston is started, it will continue. Pistons 25 may be weighted by lead inserts if additional weight is required.

As discussed in my aforementioned parent applications, the reaction force of the charge of pressured gas is exerted on the end wall of the fluid pressure chamber 20*a*, here shown as the wall 26*b* of the cylinder head 26. This force is diagrammatically illustrated in FIG. 2 by the arrow labelled $F_R$. It will be seen that the effective torque exerted by the force $F_R$ is the product of such force by the perpendicular distance existing between the axis of the fluid pressure chamber 20*a* and the axis of rotation of the body 10 and the shaft 2.

After each piston 25 initiates its inward movement, the solenoid actuated inlet valve 33 is closed in a manner to be hereinafter described, thus trapping the charge of pressured gas. Such gas is expanded and cooled while acting on the piston 25 to drive it inwardly. The expanded, cooled gas is discharged through a second valve element, hereinafter called the exhaust valve, comprising a plurality of radial ports 20*e* formed in the cylinder wall which are uncovered by the piston 25 just prior to such piston reaching the end of its inward stroke, i.e., arriving at the axis proximate end of the fluid pressure chamber 20*a*. An annular header 27 is provided in surrounding relationship to the exhaust ports 20*e* and conducts the expanded, hence cooled charge of gas through a conduit 28 to the exhaust gas collector 5*b* and to the stationary exhaust conduit 5*a* through fluid coupling 5.

Figure 4:
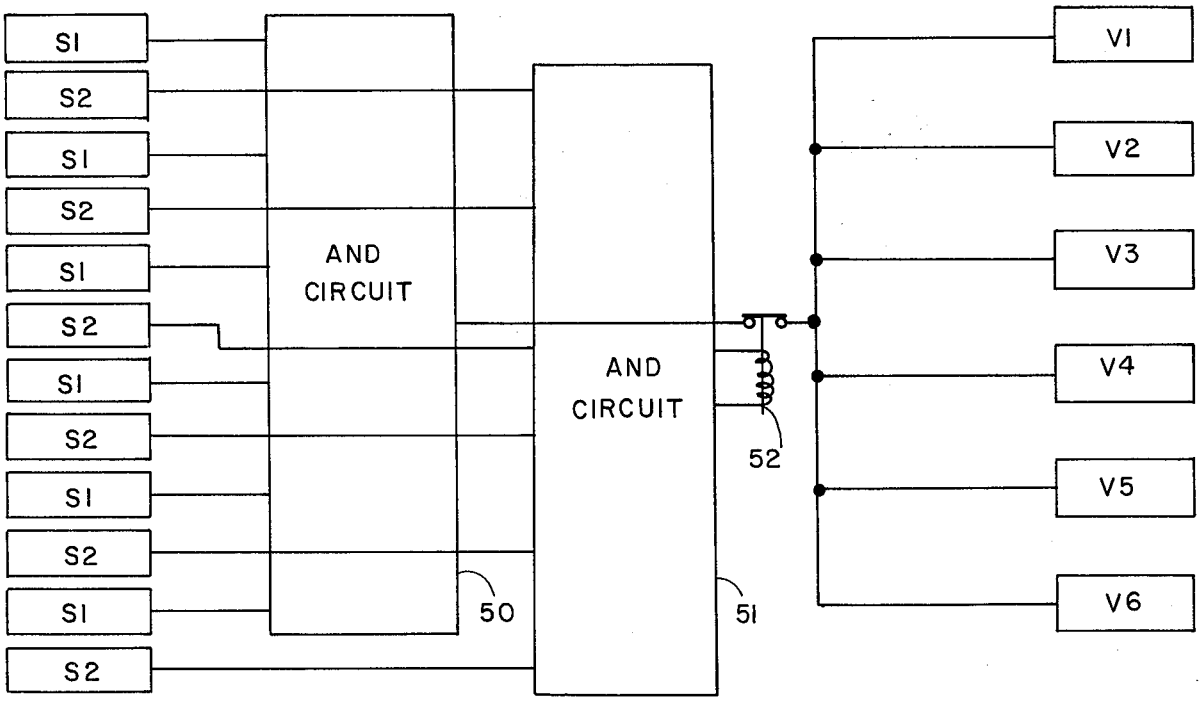
FIG. 4 is a schematic circuit diagram illustrating one control mode for the apparatus of FIG. 1.

Referring now to FIG. 4, there is shown a schematic control circuit for operating each of the solenoid controlled inlet valves 33 which are respectively labelled V1, V2 . . . V6. A pair of sensing devices S1 and S2 are provided on each of the cylinders 20 in order to respectively provide a signal when the free piston 25 is adjacent the position of such sensing device. Sensing device S1 is preferably located to provide a signal when the free piston 25 is in its outermost or remote position relative to the rotational axis. All such signals are supplied to a conventional electronic circuit 50 known as an "AND" circuit or gate which will produce an amplified output signal for concurrent application to all of the solenoid controlled inlet valves V1, V2 . . . V6 only when all of the free pistons 25 have reached their outermost position. It is thereby assured that all such pistons are energized at the same instant, thus providing for substantially synchronous inward movement of the free pistons and hence maintaining the dynamic balance of the rotating assemblage.

The second sensors S2 are mounted on the cylinders 20 at a position radially inward from the sensors S1. The exact location of the sensors S2 depends upon the amount of pressured gas that is desired to be applied to each fluid pressure chamber 20*a*. If the objective of the apparatus is to primarily effect a conversion of the pressured gas to mechanical energy, then the energizing circuit for valves V, V2 . . . V6 should incorporate a conventional self-energizing or self-locking feature and the sensors S2 will be respectively located well inward from the sensors S1 in order to provide for a maximum duration of application of pressured gas to the respective fluid pressure chamber 20*a*. Sensors S2 are connected through a second "AND" circuit or gate 51 to operate relay 52 which interrupts the supply of actuating current to the solenoid controlled inlet valves V1, V2 . . . V6. Alternatively, each of the sensors S2 could be connected through a separate amplifying circuit and relay directly to the corresponding valve V1, V2 . . . V6 so that each of such valves is closed as a function of the position of the piston in the respective cylinder, rather than effecting the closing at the time that all of the free pistons reach the positions in the fluid pressure chamber corresponding to the locations of the sensors S2.

In the control mode illustrated in FIG. 4, all of the pistons 25 are concurrently acted on by a charge of gas and, hence, start their respective inward strokes at the same time. In this manner, the pistons are maintained in reasonable synchronism and a dynamic balance of the rotating components is assured. It may be preferred to concurrently actuate the pistons of two diametrically opposed cylinders at one time and then periodically thereafter actuate the remaining pairs of diametrically opposed pistons in sequence, thus applying intermittent pulses of power to the output shaft 2. This alternative control mode is schematically illustrated in my aforementioned co-pending parent applications and will not be further described herein.

On the centrifugally produced return movement of the free pistons 25 to their radial outward positions, the sensor S2 has no effect, since the energizing circuit for the inlet valves 33 is already in a de-energized condition due to the departure of the pistons 25 from the respective sensors S1.

It should be emphasized that any one of the variety of centrifugal piston expanders disclosed in my aforementioned co-pending parent applications may be employed in conjunction with the closed cycle method first disclosed in this application.

Figure 5:
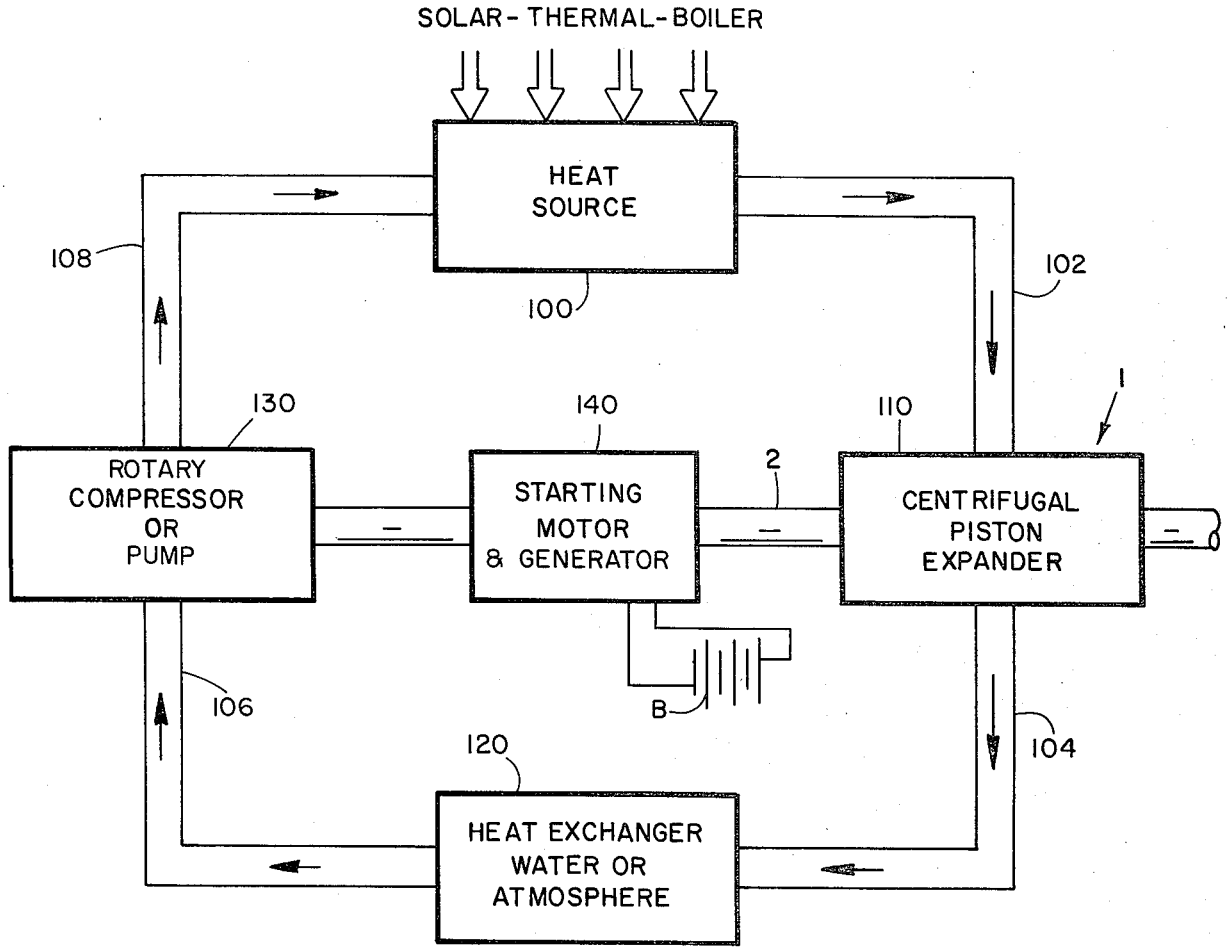
FIG. 5 is a schematic circuit diagram of a closed cycle system for converting the energy of a heat source into mechanical energy through the utilization of a centrifugal piston expander driven by a compressed heated gas.

Referring now to FIG. 5, there is schematically disclosed a closed cycle system for effecting the extraction of mechanical energy from a heat source. Heat source 100 may comprise any conventional form of gas-liquid heating apparatus, such as a boiler, fired by any conveniently available fuel, or a heat exchange unit energized by solar energy. Conceivably, when nuclear energy becomes available in less expensive configurations, the heat source may even employ nuclear energy to effect the heating of the circulating charge of gas.

In any event, the gas or gas-liquid mixture introduced into heat source 100 is heated to a level to convert all of the liquid to gas and to bring the pressure of the gas up to a desired level for effecting the operation of the particular centrifugal expander from which mechanical energy is to be derived. Any gas that converts to a liquid at a reasonable temperature, such as steam or Freon, may be utilized. The heated, pressurized gas is supplied to the centrifugal piston expander 110 through conduits 102 and effects the driving of a power output shaft 2 upon which the cylinders (not shown) of the centrifugal piston expander 110 are mounted. Any of the cylinder configurations described in detail in my aforementioned co-pending parent applications may be utilized as the piston expander 110, but for reference convenience, the piston expander 110 may be considered to be the expander apparatus 1 shown in FIGS. 1–3, heretofore described, and operated according to the control mode illustrated in FIG. 4.

The expanded gas discharged from the centrifugal piston expander 110 is supplied to conduit 104 and is then directed to a heat exchanger or condenser 120 and subjected to cooling action either by a flow of cooling water or atmospheric air. In any event, sufficient additional heat is extracted from the cooled expanded gas to satisfy the entropy requirements of the closed cycle. The cooled gas outlet from the heat exchanger 120, which may be partially liquid, is then applied thru conduit 106 to the inlet of a compressor or pump 130, and is compressed by the compressor 130 to a pressure level at least equal to that existing in the heat source chamber 100. Conduit 108 connects compressor 130 to heat source chamber 100. Such compression will normally effect the complete conversion of the gas to a liquid but in any event, the liquid or the gas-liquid mixture is supplied to the heat source chamber 100 for heating and recirculation. Obviously, the location of the heat exchanger or condenser 120 relative to the compressor pump 130 may be reversed inasmuch as its only function is to insure the removal of sufficient heat from the circulating gas to satisfy the entropy requirements of the closed cycle. Hence, they will hereinafter be referred to as "series connected".

As is customary with the centrifugal piston expanders, a starting motor 140 is also connected to the power output shaft 2 to insure that the rotating cylinders of the centrifugal piston expander 110 will achieve a sufficiently high rotational speed to cause the pistons of the expander to be centrifugally displaced to their outermost positions, thus permitting the expander to function. After the centrifugal piston expander 110 starts operating and generating mechanical power, the motor 140 may be driven in an overspeed condition to function as a generator to re-charge a battery B.

Figure 6:
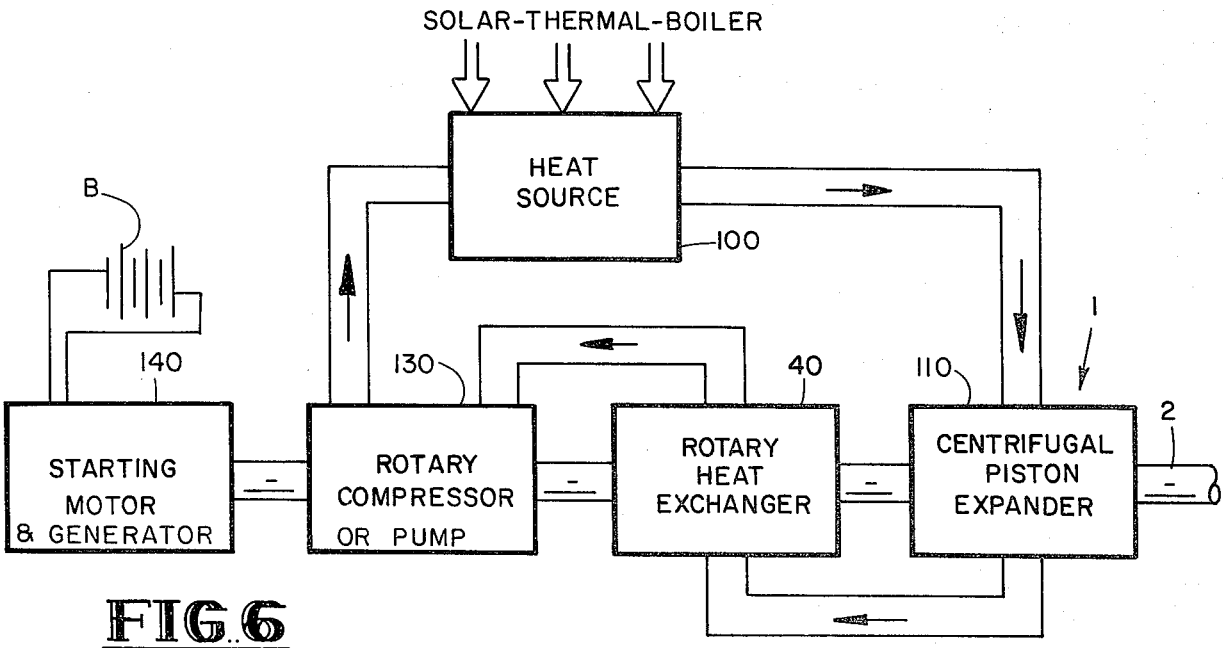
FIG. 6 is a view similar to FIG. 5 but showing a modification of the cycle wherein a rotary heat exchanger is also driven by the power output shaft of the centrifugal piston expander.

Referring now to FIG. 6, there is shown an alternative closed cycle system utilizing a centrifugal piston expander. In this system, the heat exchanger takes the form of a rotary device 40 which is also mounted for rotation on the power shaft 2. The rotary heat exchanger 40 may be identical in construction to the unit shown in FIG. 8 and herein after described in detail. The structure will, by exposure to an air stream passing through the rotating structure effect the required cooling of the charge of gas or liquid-gas which is circulating through the closed system.

In some instances, it may be desirable to effect a forced exhaust of the cooled, expanded gases from the cylinder elements of the centrifugal piston expander, rather than relying upon a suction pressure of the compressor to produce an adequate flow of such exhaust gases out of the cylinder. Obviously, the exhaust ports **20*e* in each of the cylinders 20 are open for only a very short time while the free piston 25 is in its axis proximate position. To overcome this problem, the modifications of FIGS. 7 through 9** have been developed.

Figure 7:
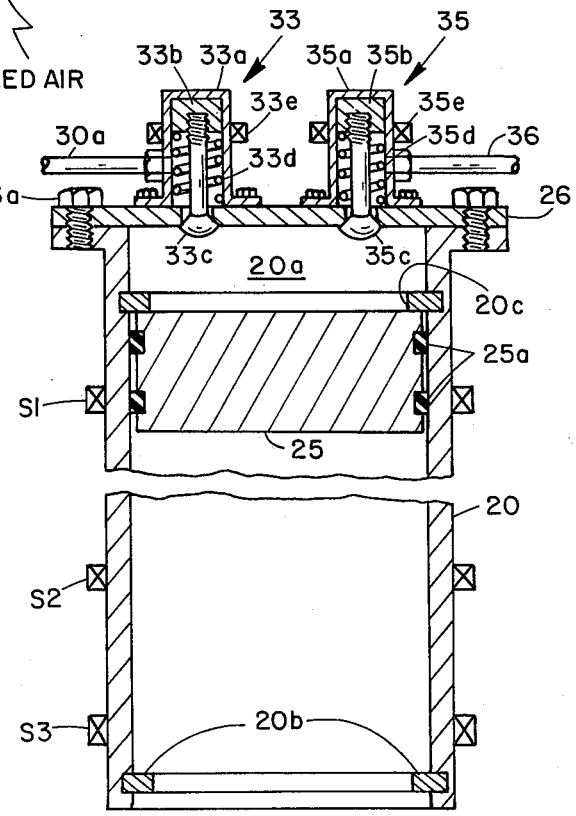
FIG. 7 is an enlarged scale, partial sectional view of a modified cylinder and valving arrangement for a centrifugal piston expander incorporated in the system of this invention.

Referring first to FIG. 7, the exhaust of cooled, expanded gas from each fluid pressure chamber **20*a* is accomplished by a solenoid actuated exhaust valve 35 which is mounted on the cylinder head 26. The exhaust valve 35 is of identical construction to the solenoid actuated inlet valve 33 and thus comprises a cylindrical, non-ferrous casing 35*a* within which a ferromagnetic piston 35*b* is slidably mounted. A valving element 35*c* is threadably secured to the ferromagnetic piston element 35*b* and is normally spring biased to a closed position by a spring 35*d*. Conduits 36 respectively connect to the interior of the valve housing 35*a* through radial ports located below the ferromagnetic piston element 35*b*. An actuating solenoid 35*e* is provided in surrounding relationship to the medial portions of the valve housing 35*a*. Such solenoid, when energized, will cause the ferromagnetic piston element 35*b* to be pulled downwardly to effect the opening of the exhaust valve 35**.

Figure 8:
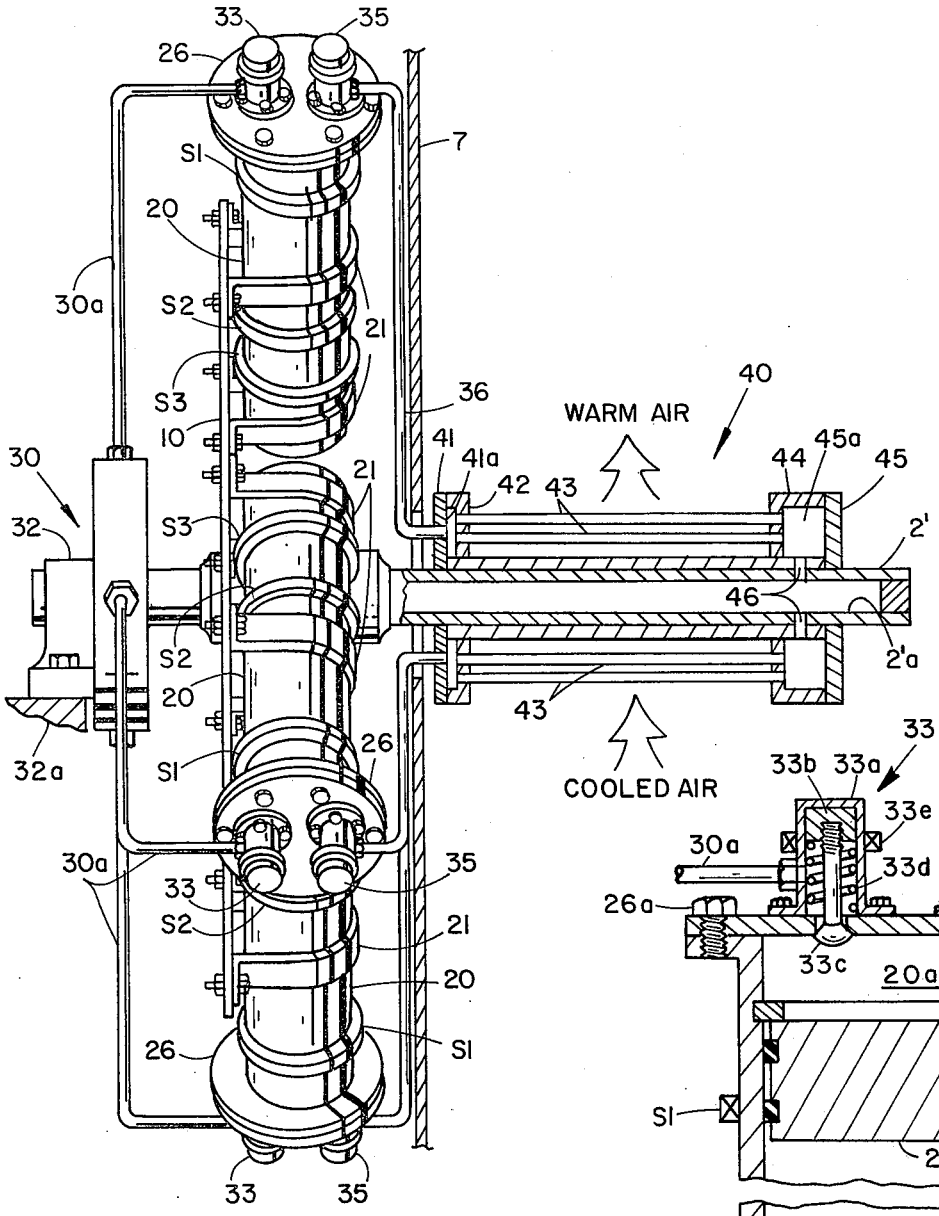
FIG. 8 is a schematic elevational view, partly in section, of a closed cycle, centrifugal expander engine incorporating the cylinders of FIG. 7.
Figure 9:
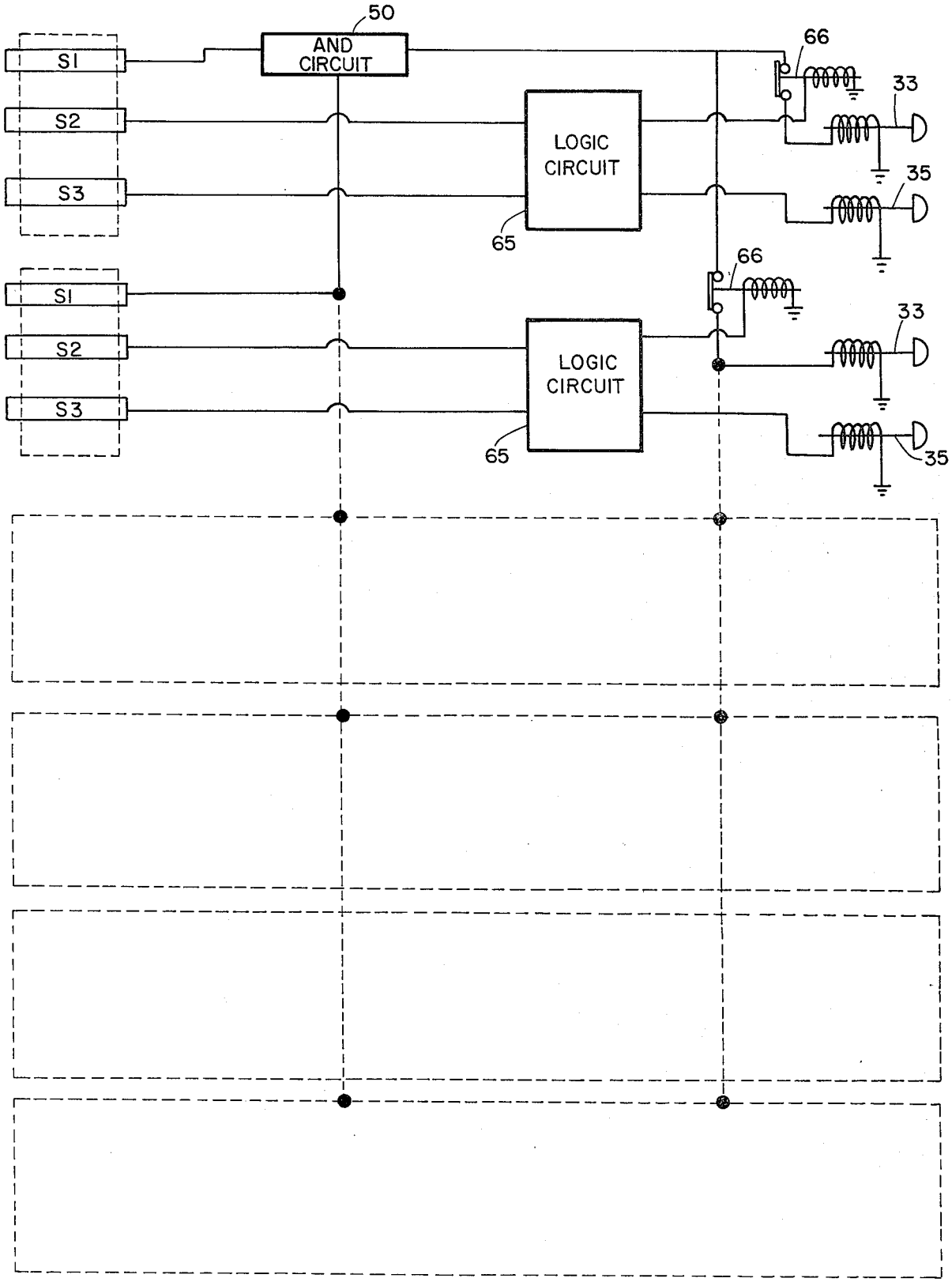
FIG. 9 is a schematic circuit diagram illustrating a control mode for the inlet and exhaust valves of the modification of FIG. 8.

Referring now to FIG. 8, there is shown a centrifugal piston expander operating in a closed cycle and incorporating the exhaust valving arrangement of FIG. 7. It will be noted that the conduits 36 leading from the exhaust valve unit 35 will be respectively connected to the series connected compressor and heat exchanger elements shown in the schematic diagrams of FIG. 5 or FIG. 6. All other elements of this structure are identical to those previously described in connection with the modification of FIGS. 1–3, except that the rotary heat exchanger 40 has been added.

The rotary heat exchanger 40 is disposed within the path of a stream of relatively cool air which is only schematically indicated in FIG. 8. Heat exchanger 40 comprises an end plate 41, co-rotatably with the hollow power shaft 2', which receives the ends of the exhaust fluid conduits 36. Immediately adjacent to the end plate member 41, there is secured a header 42 which provides a mounting for a plurality of peripherally spaced, axially extending tubes 43, which have their opposite ends mounted in a header 44 generally similar to the header 42. A second end plate 45 is secured to the second header 44 and co-rotatably mounted on the power shaft 2'. Annular chambers **41*a* and 45*a* are respectively defined between the end plate 41 and header 42 and between end plate 45 and header 44. Chamber 45*a* is connected to the bore 2'*a* of hollow shaft 2' by radial ports 46, thus permitting the cooled gas to flow through the bore 2'*a* of the hollow shaft 2' to the inlet (not shown) of the compressor 30 which is co-rotatably mounted on the output power shaft 2' on the opposite side of the body 10. A pressured mixture of liquid or liquid-gas is transmitted through the output of compressor 30 by conduits 30*a* to the inlet ports of the solenoid controlled inlet valves 33. For more effective operation of the rotary heat exchanger 40, an insulating barrier 7 may be provided in the form of a wall between the rotary heat exchanger 40** and the rotating centrifugal piston expander unit.

The control circuitry for the closed cycle engine unit shown in FIG. 8 must, of course, be modified to provide for the operation of the solenoid controlled exhaust valve 35 at the proper intervals, as determined by the position of the free piston 25 in the respective fluid pressure chamber **20*a*. Such operation may be accomplished through the addition of a third sensor S3 to each of the cylinders 20 at a position near the axis proximate end of the fluid pressure chamber 20*a*. Thus, sensor S3 detects when the respective free piston 25 reaches its extreme inward or axis proximate position. When each free piston 25 arrives at such position, the signal generated by sensor S3 operates through a conventional logic circuit 65 to effect the opening of the respective exhaust valve 35. A conventional self-locking or self-energizing circuit (not shown) holds exhaust valve 35 in its open position. The sensors S1, which are located adjacent to the outermost or axially remote position of the free piston 25 function through a conventional AND gate or circuit 50, in the same manner as described in connection with FIG. 4, to cause the concurrent opening of all of the solenoid actuated inlet valves 33**.

The sensor S2 now performs a dual function. On the inward movement of the free piston 25, the respective sensor S2 produces a signal which operates through the logic circuit 65 to effect the closing of the respective inlet valves 33. On the return movement of the free piston 25, the sensor S2 produces a signal line to open relay 66 and effect the closing of the solenoid actuated exhaust valve 35.

It is therefore apparent that the expanded, cooled gas in each of the cylinders is compressed and discharged by the centrifugal force induced outward strokes of the free pistons 25 through the solenoid actuated exhaust valve 35 during a substantial portion of the outward strokes of such pistons. Thus, the cooled, expanded gas is forcibly applied to the inlet of the series connected compressor and heat exchanger as schematically illustrated in FIGS. 5 and 6.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. The method of extracting mechanical energy from a heat source comprising the steps of:

1. Circulating a charge of a phase convertible, pressured gas in a closed cycle from the heat source to a centrifugal piston expander having a power output shaft, to a series connected heat exchanger and compressor, and then back to the heat source; said rotary expander having a plurality of cylinders co-rotatably mounted on the power output shaft and respectively containing pistons movable solely by gas pressure from a position remote from the axis of rotation of the cylinders to a position proximate to said axis and movable from said proximate position to said remote position solely by centrifugal force;
2. Rotating the power output shaft by a starting motor;
3. Introducing a charge of heated gas in the radially outer ends of said cylinders when said pistons are positioned by centrifugal force in said axially remote positions, thereby driving said pistons inwardly to expand the gas and exerting a reaction torque on the cylinders to drive the power output shaft;
4. Discharging the expanded gas into said series connected heat exchanger and compressor to cool and pressurize same prior to introduction into said heat source; and
5. Driving said compressor by said power output shaft of said rotary expander.

2. The method of claim 1 wherein said circulating charge of gas is liquified prior to introduction into said heat source and converted to a pressured gas by said heat source.

3. The method of claim 1 wherein said heat exchanger is a rotary type driven by said power output shaft.

4. The method of claim 1 wherein the step of discharging the expanded gas is accomplished by the centrifugally produced outward movement of the pistons.

5. Apparatus for extracting mechanical energy from a heat source comprising, in combination, a boiler chamber containing a pressured gas heated by the heat source; a power shaft; a starting motor for rotating said power shaft; a centrifugal piston expander having a plurality of angularly spaced cylinders secured to said shaft for co-rotation and respectively defining non-radial fluid pressure chambers extending from a point remote from the axis of rotation to a point proximate to the axis; a piston reciprocably movable in each said fluid pressure chamber solely under the influence of gas pressure and centrifugal force; means including an inlet valve for supplying pressured gas from said boiler chamber to the remote end of said fluid pressure chamber; means including an exhaust valve for discharging expanded gas from said chambers after said pistons respectively approach said axis proximate ends of said fluid pressure chambers; a series connected compressor and heat exchanger; first conduit means for supplying said exhaust gas to said series connected compressor and heat exchanger to cool and pressurize said exhaust gas; and second conduit means for supplying the cooled pressurized gas to said boiler chamber.

6. The apparatus of claim 4 wherein said series connected compressor and heat exchanger effect the conversion of a portion of said exhaust gas to a liquid.

7. The apparatus of claim 4 wherein said heat exchanger and said compressor comprise rotary units co-rotatable with said power shaft.

8. The apparatus of claim 5 wherein said exhaust valve is located in said remote end of each said fluid pressure chamber; and means for opening each said exhaust valve only during the centrifugally produced movement of the respective piston away from said axis proximate end of said respective fluid pressure chamber, thereby pumping the exhaust gases into said series connected compressor and heat exchanger.

9. The apparatus of claim 5 wherein said starting motor is battery powered, thereby permitting charging of the battery by driving said motor in an overspeed condition.

* * * * *